US009586231B2

(12) United States Patent
Brasher

(10) Patent No.: US 9,586,231 B2
(45) Date of Patent: Mar. 7, 2017

(54) COATING REINFORCEMENT APPLICATION AND METHOD

(71) Applicant: Jon H Brasher, Opelika, AL (US)

(72) Inventor: Jon H Brasher, Opelika, AL (US)

(73) Assignee: Ovante, LLC, Tallahassee, FL (US)

( * ) Notice: Subject to any disclaimer, the term of this patent is extended or adjusted under 35 U.S.C. 154(b) by 204 days.

(21) Appl. No.: 14/038,883

(22) Filed: Sep. 27, 2013

(65) Prior Publication Data

US 2015/0093504 A1 Apr. 2, 2015

Related U.S. Application Data

(63) Continuation-in-part of application No. 12/543,978, filed on Aug. 19, 2009, now abandoned.
(Continued)

(51) Int. Cl.

| | |
|---|---|
| ***B05D 3/00*** | (2006.01) |
| ***B05D 7/22*** | (2006.01) |
| ***B05D 3/02*** | (2006.01) |
| ***B05D 1/02*** | (2006.01) |
| ***B05D 1/12*** | (2006.01) |
| ***B05D 3/04*** | (2006.01) |
| ***B05D 7/02*** | (2006.01) |
| ***B05D 7/00*** | (2006.01) |
| ***B05D 7/14*** | (2006.01) |
| *B05D 3/12* | (2006.01) |

(52) U.S. Cl.

CPC ..... *B05D 3/0218* (2013.01); *B05D 1/02* (2013.01); *B05D 1/12* (2013.01); *B05D 3/0413* (2013.01); *B05D 7/00* (2013.01); *B05D 7/02* (2013.01); *B05D 7/14* (2013.01); *B05D 7/22* (2013.01); *B05D 3/12* (2013.01); *B05D 2202/00* (2013.01); *B05D 2252/10* (2013.01); *B05D 2259/00* (2013.01); *B05D 2350/00* (2013.01); *B05D 2350/30* (2013.01)

(58) Field of Classification Search
None
See application file for complete search history.

(56) References Cited

U.S. PATENT DOCUMENTS 3,470,598 A * 10/1969 Berthelsen ..... B29C 47/025 228/142
4,466,989 A * 8/1984 Haller ..... B05C 19/02 118/421

(Continued)

OTHER PUBLICATIONS

Lee, S., "Thermoplastic Polyurethane Markets in the EU: Production, Technology, Applicaitons and Trends," Copyright Rapra Technology Limited, 1998, pp. 48 & 49.*

*Primary Examiner* — William Phillip Fletcher, III
(74) *Attorney, Agent, or Firm* — J. Wiley Horton

(57) ABSTRACT

A method for applying a polymer to a substrate having a first surface and a second surface (such as an inside surface and outside surface). One or more apertures are provided through the substrate, with the apertures linking the first and second surfaces. A polymer coating is applied to the first and second surfaces, with some of the polymer coating flowing into and remaining within the aperture(s). The polymer coating within the aperture(s) serves to link the polymer coating covering the first surface and the polymer coating covering the second surface. The invention also encompasses coated objects made using the inventive method.

20 Claims, 5 Drawing Sheets

Related U.S. Application Data

(60) Provisional application No. 61/090,592, filed on Aug. 20, 2008.

(56) References Cited

U.S. PATENT DOCUMENTS

| | | | | |
|---|---|---|---|---|
| 4,806,387 | A * | 2/1989 | Tamaki | B05D 1/24 118/DIG. 5 |
| 2005/0123723 | A1* | 6/2005 | Wang | 428/140 |
| 2007/0128963 | A1* | 6/2007 | Vogt et al. | 442/301 |

* cited by examiner

COATING REINFORCEMENT APPLICATION AND METHOD

CROSS-REFERENCES TO RELATED APPLICATIONS

This non-provisional patent application is a continuation-in-part of U.S. patent application Ser. No. 12/543,978. The parent application was filed on Aug. 19, 2009 and listed the same inventor.

STATEMENT REGARDING FEDERALLY SPONSORED RESEARCH OR DEVELOPMENT

Not Applicable.

MICROFICHE APPENDIX

Not Applicable member

BACKGROUND OF THE INVENTION

1. Field of the Invention

This invention relates to the field of corrosion protection. More specifically, the invention comprises a method and system for applying a protective coating to a substrate and ensuring that the protective coating remains well-bonded.

2. Description of the Related Art

Many objects are used outdoors to serve a variety of functions. Outdoor objects may be made from numerous materials, for example, they may consist of plastics or metals. The outdoor objects are exposed on a day-to-day basis to changing and sometimes harsh weather conditions and/or other external considerations.

In addition, many objects include both external and internal surfaces. Protective coatings are often applied to the external surface while leaving the internal surface untreated. The internal surface may be subjected to elevated humidity levels because of trapped moisture. It is certainly preferable to provide a method that treats both internal and external surfaces.

Without some type of protection, outdoor objects can rapidly deteriorate. Therefore, oftentimes these outdoor objects are coated with some type material that tends to protect them from the harsh weather conditions and/or other external anomalies. However, the coating that is placed on the objects oftentimes, over time, tends to crack and peel away from the outdoor object. It is therefore preferable to provide a system and method for adhering the coating to a substrate so that it resists separation.

BRIEF SUMMARY OF THE PRESENT INVENTION

The present invention comprises a method for applying a polymer to a substrate having a first surface and a second surface (such as an inside surface and outside surface). One or more apertures are provided through the substrate, with the apertures linking the first and second surfaces. A polymer coating is applied to the first and second surfaces, with some of the polymer coating flowing into and remaining within the aperture(s). The polymer coating within the aperture(s) serves to link the polymer coating covering the first surface and the polymer coating covering the second surface. The invention also encompasses coated objects made using the inventive method.

A first embodiment of the invention comprises a substrate having a first and second surface and an aperture formed in the substrate that extends from the first surface to the second surface of the substrate. A polymer-type coating is formed on the first surface and a polymer-type coating is formed on the second surface, the polymer-type coating formed on the first surface extending through the aperture and the polymer-type coating formed on the second surface extending through the aperture thereby connecting the polymer-type coating formed on the first surface with the polymer-type coating formed on the second surface.

A method in accordance with an embodiment of the present disclosure comprises creating at least one aperture in a substrate and applying a polymer-type coating to a first and second surface of the substrate, and the polymer type coating fills the aperture thereby connecting polymer-type coating on the first surface to the polymer-type coating on the second surface. The method further comprises curing the coating.

Various methods of attaching the substrate are included, with a preferred embodiment heating the substrate prior to the application of the polymer.

Figure 1:
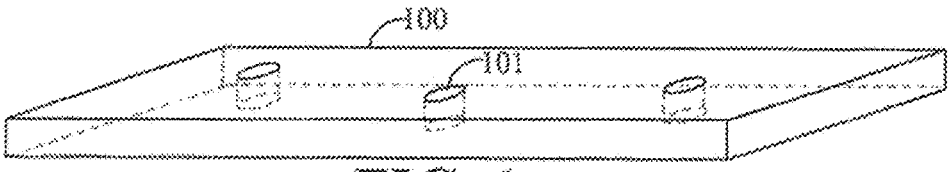
FIG. 1 is a perspective view of an exemplary substrate having a plurality of apertures in accordance with an embodiment of the present disclosure.

| REFERENCE NUMERALS IN THE DRAWINGS | |
|---|---|
| 100 substrate | 101 aperture |
| 102 coating | 103 coating |
| 105 coating portion | 200 first surface |
| 201 second surface | 500 substrate |
| 600 pole | 601 inside surface |
| 602 outside surface | 603 aperture |
| 700 coating | 701 coating |
| 900 aperture forming step | 901 polymer application step |
| 902 curing step | |

DETAILED DESCRIPTION OF THE INVENTION

The present disclosure generally relates to coating reinforcement systems and methods. In particular, the present disclosure relates to a system whereby a structure is protected from environmental conditions, such as, for example harsh weather conditions, by applying a coating, such as, for example, a polymer-type material, to two or more surfaces of the structure.

The polymer coating is selected to be thick and strong, so that it may be applied in a single thick sheet. It is preferably non-porous, non-fibrous, inert, and non-chemically bonding. The polymer selected should have a shear-strength sufficient to avoid cracking, flaking, or tearing. Instead, it should delaminate as a unified sheet. It preferably does not need to be applied in layers. The single-ply thickness is preferably greater than 0.250 inches and may be as much as 0.750 inches. Delamination is avoided by mechanically linking two or more coated surfaces together using aperture(s) passing between the surfaces. The apertures are at least partially filled with the polymer, so that a polymer coating on a first surface is mechanically joined to a polymer coating on a second surface by polymer flowing through the aperture (s).

In accordance with the present disclosure, the coating is reinforced by the perforation of the structure, i.e., one creates apertures in the structure that extend from one surface of the structure to the other. The coating adheres to both surfaces of the structure, and also fills the apertures (at least partially) thereby reinforcing the polymer coating after it hardens and adheres to the surface of the structure and hardens and adheres within the apertures. The coating that fills the apertures reinforces the coating on the surfaces so that the coating will not flake or peel away from the surface of the structure as a result of wear or harsh weather conditions.

FIG. 1 depicts an exemplary substrate 100 in accordance with an embodiment of the present disclosure. The substrate 100 may comprise any type of material, including metallic, plastic, or fiberglass material. Notably, the substrate 100 may comprise other types of materials known in the art or future-developed. Within the substrate 100 are a plurality of apertures 101 that extend completely through the substrate 100.

The number, size, and shape of the apertures may vary depending upon the application. Thus, while three circular apertures 101 are shown in FIG. 1, this is for exemplary purposes only.

In one embodiment, the aperture 101 has a diameter that is substantially equal to the thickness of the substrate 100. In such an embodiment, there is a direct relationship between the thickness of the substrate 100 and the desired diameter of the aperture 101.

Note that the apertures may be formed in the structure using any type of process known or future-developed, including, but not limited to drilling, punching, stamping, or any other method for generating the apertures 101. Further note that the apertures 101 may be in a random or ordered pattern in the substrate, which is described further herein. The pattern shown in FIG. 1 is a random pattern of three apertures.

Figure 2:
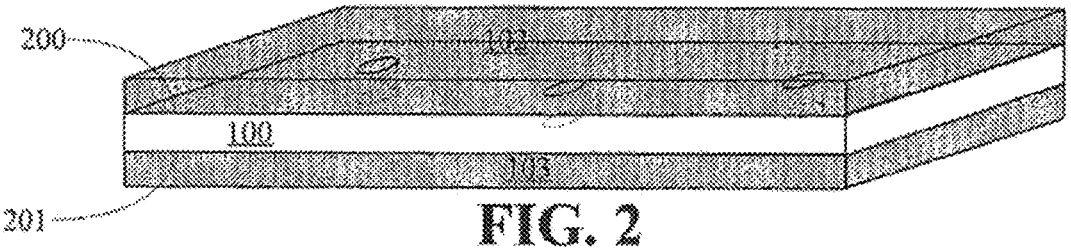
FIG. 2 is a perspective view of the substrate of FIG. 1 further having coatings adhered to two surfaces of the substrate.

FIG. 2 depicts the substrate 100 having a coating 102 on a first surface 200 of the substrate 100, and a coating 103 on a second surface 201 of the substrate 100. In one embodiment, the coatings 102, 103 consist of a polymer-type material, however, other types of materials may be used in other embodiments for protecting the substrate 100 from, for example, weather elements.

Note that in one embodiment, the substrate 100 is treated before the coatings 102, 103 are applied to the substrate 100. If the substrate 100 comprises, for example, a metallic material, then it may be desirable to galvanize the surfaces 200, 201 of the substrate 100 or cover the surfaces 200, 201 of the substrate 100 with a primer (not shown), for example, before applying the coatings 102, 103. Galvanization or priming ensures that the coatings 102, 103 stick to the surfaces 200, 201 of the substrate 100.

If the substrate 100 comprises, for example, plastic or fiberglass, it may be desirable to prime or etch the surfaces 200, 201 of the substrate 100. Priming or etching the surfaces 200, 201 of the substrate 100 ensures that the coatings 102, 103 stick to the surfaces 200, 201 of the substrate 100.

In one embodiment, the coatings 102, 103 can be applied through a heating process. In this regard, the substrate 100 is preferably heated to a temperature above 200 degrees Fahrenheit, even more preferably above 250 degrees Fahrenheit, and even more preferably above 300 degrees Fahrenheit. In one embodiment, a temperature of 315 degrees Fahrenheit (F) is used. Note that 315 degrees F. is provided as an exemplary desired temperature, and other temperatures may be used in other embodiments.

The polymer-type material is then applied to a specified thickness. Notably, the thickness to which the polymer-type material is applied varies depending upon the application of the coatings 102, 103. The polymer-type material is applied by immersing the substrate 100 in the polymer-type material, by wrapping a layer of raw polymer-type material about the heated substrate 100, by spraying the polymer material onto the heated substrate, or any other suitable method.

When the polymer-type material contacts the heated substrate 100, it melts and adheres to the substrate 100. As it melts to the substrate 100, portions of the polymer-type material form the coatings 102, 103 and portions pass through the apertures 101 thereby linking the coatings 102, 103 one to the other. In one embodiment, the temperature of the substrate 100 is maintained for twenty minutes to cure the coatings 102, 103.

The temperature of the substrate 100 may be maintained in a number of ways. As an example, in one embodiment, the temperature of the substrate 100 may be maintained by convection. In this regard, hot air may be blown over the substrate 100 to bring the substrate 100 to the desired temperature and maintain the temperature prior to coating and during coating of the substrate 100 until the substrate 100 is cured.

In another embodiment, the substrate 100 may be placed in an oven to reach the desired temperature. Once the substrate reaches the desired temperature, the substrate 100 may then be removed from the oven, immersed in the polymer-type material, then placed back into the oven until the coatings 102,103 of the polymer-type material cure.

In another embodiment, a positive charge may be applied to the substrate 100. The positive charge induces a current in the substrate 100 that causes the substrate 100 to heat to the desired temperature. The polymer-type material is then applied to the substrate 100 when it reaches the desired temperature, and the current continues to flow through the substrate 100 until curing occurs forming the coatings 102, 103.

In another embodiment, raw polymer-type material may be applied to the substrate within a vacuum chamber. The vacuum causes the raw polymer-type material to conform to the substrate and a portion of the raw polymer-type material to pass through the apertures 101. Thus, the coatings 102, 103 are formed. To cure, heat is applied within the vacuum chamber at the desired temperature in order to cure the coatings 102, 103.

Figure 3:
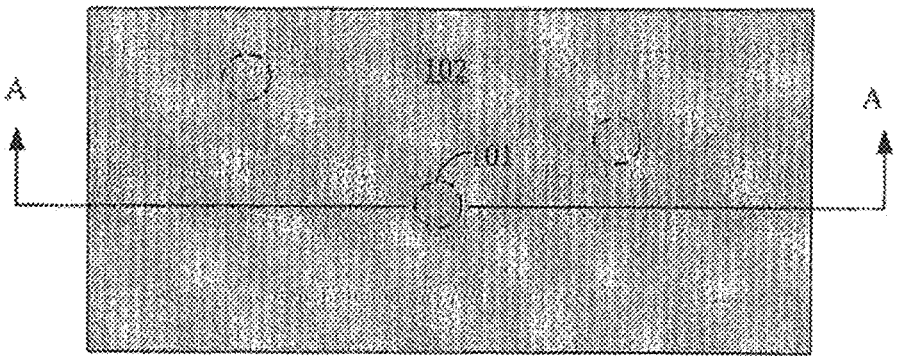
FIG. 3 is a top plan view of the coating adhered to the substrate as depicted in FIG. 2.
Figure 4:
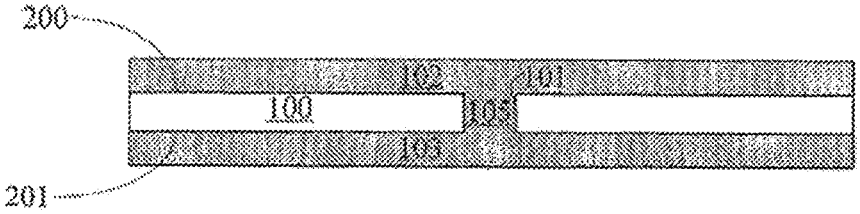
FIG. 4 is a cross-sectional view of the substrate and the coatings taken along line A-A' of FIG. 3.

FIG. 3 is a top plan view of FIG. 2 showing the coating 102 in relation to the apertures 101. FIG. 4 is a cross-sectional view of FIG. 3 taken along line A-A' of FIG. 3. Notably, when the coating 102 is applied to the surface 200 of the substrate 100, and the coating 103 is applied to the surface 201 of the substrate 100, a portion of the coating 105 fills the aperture 101, thereby supporting and reinforcing the coating 102, 103 that adheres to the substrate 100. In this regard, the coating 105 connects the coating 102 to the coating 103, thereby supporting and reinforcing the coatings 102, 103. Such support reduces cracking, chipping, and peeling that may result from harsh weather, for example.

Figure 5:
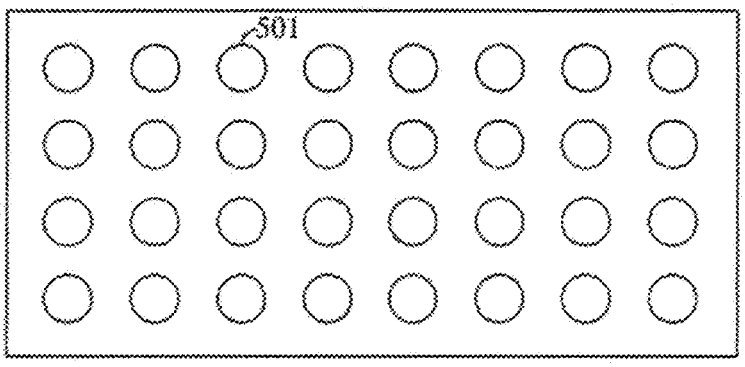
FIG. 5 is a top plan view of an exemplary substrate in accordance with another embodiment of the present disclosure.

FIG. 5 depicts a top plan view of a substrate 500 in accordance with another embodiment of the present disclosure. Substrate 500 differs from the substrate 100 (FIG. 1) in that a plurality of apertures 501 are created in the substrate 500 in an ordered pattern, i.e., in rows and columns. In contrast, the apertures 101 (FIG. 1) are randomly created in the substrate 101.

Figure 6:
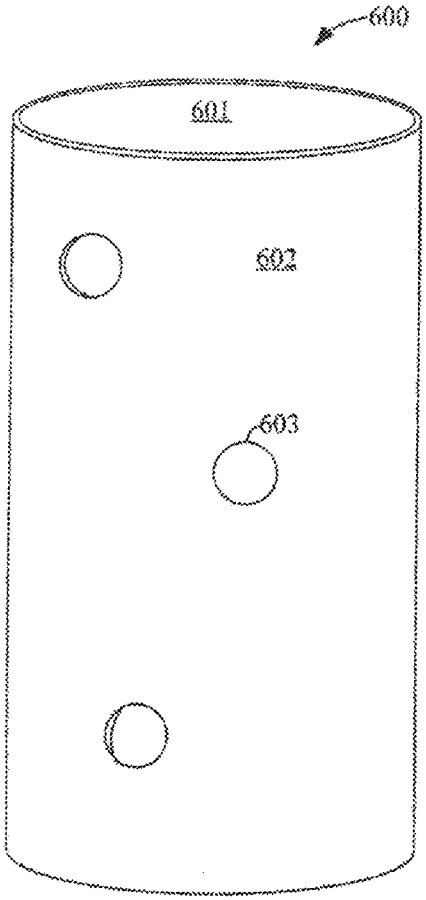
FIG. 6 is a perspective view of an exemplary pole having a plurality of apertures in accordance with an embodiment of the present disclosure.
Figure 7:
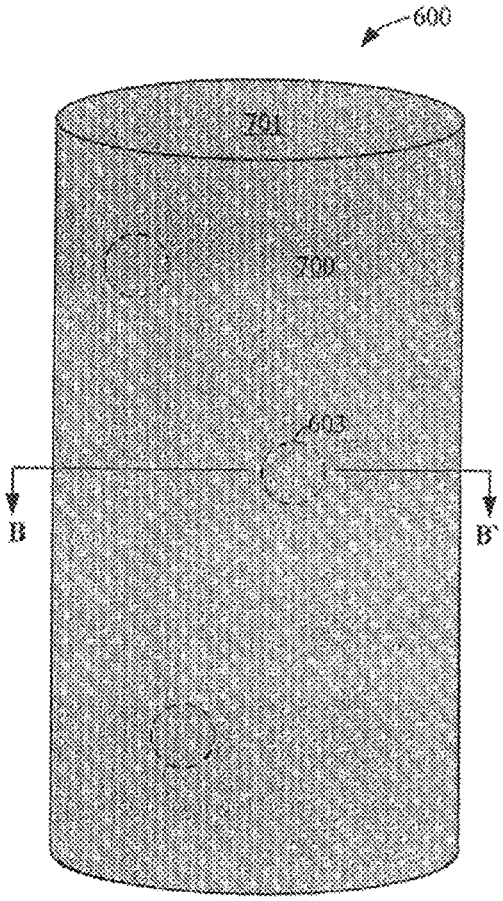
FIG. 7 is a perspective view of the pole of FIG. 5 further having coatings adhered to an inside surface and an outside surface of the pole.
Figure 8:
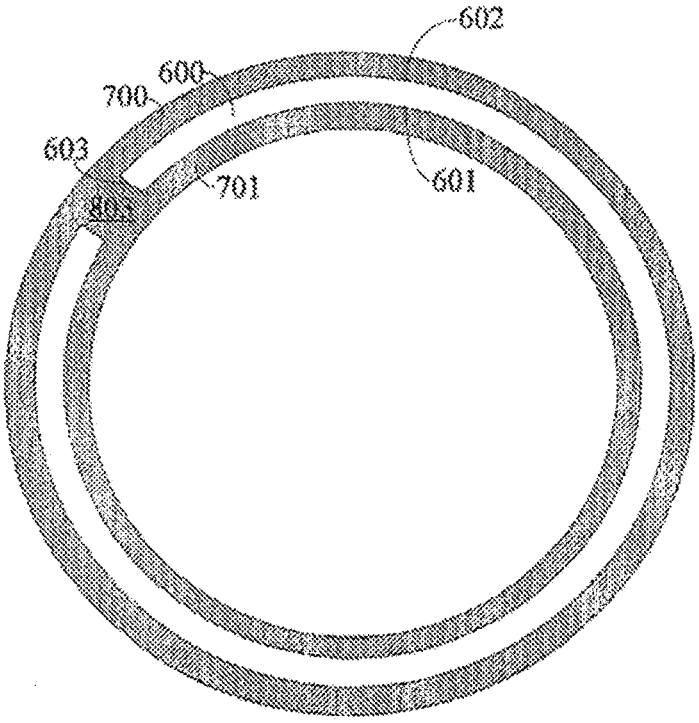
FIG. 8 is a cross-section view of the pole and the coatings taken along line B-B' of FIG. 6.

FIGS. 6-8 as described illustrate one application of the present disclosure. In this regard, FIG. 6 depicts a pole 600, such as, for example, an outdoor lighting pole. The pole 600 comprises a hollow cylinder. The two surfaces of the lighting pole are inside surface 601 and outside surface 602. In addition, the pole 600 comprises a plurality of apertures 603 that extend from the outside surface 602 to the inside surface 601.

FIG. 7 depicts the pole 600 having a coating 700 on its outside surface 602 (FIG. 6) and a coating 701 on its inside surface 601 (FIG. 6). In one embodiment, the coatings 700, 701 comprise a polymer-type material; however, other types of materials may be used in other embodiments for protecting the pole 600 from weather elements, for example.

FIG. 8 is a cross-sectional view of FIG. 7 taken along line B-B'. When the coating 701 is applied to the inside surface 601 of the pole 600 and the coating 700 is applied to the outside surface 602 of the pole 600, coating 803 fills the aperture 603 (at least partially), thereby supporting and reinforcing the coating 700, 701 that adheres to the pole 600. In this regard, the coating 803 connects the coating 700 to the coating 701. Such support reduces cracking, chipping, and peeling that may result from harsh weather, for example.

It is possible to provide a moving assembly that provides the necessary heating, coating application, and curing to only a portion of a pole. Those skilled in the art will know that utility poles are tall vertical objects that are not easily laid flat for operations such as corrosion protection. Accordingly, in one embodiment of the present invention, a ring structure may be provided around a short section of the pole. This ring structure may be supported using cables attached to the top of the pole or by some other means. The ring structure could then be advanced along the height of the pole.

The ring structure would carry heating elements and polymer applying elements. It might even carry aperture-creating elements (though in many cases the apertures would have been created beforehand). The ring structure would heat a small portion of the pole and apply the polymer when the pole's surfaces reached the proper temperature.

Figure 9:
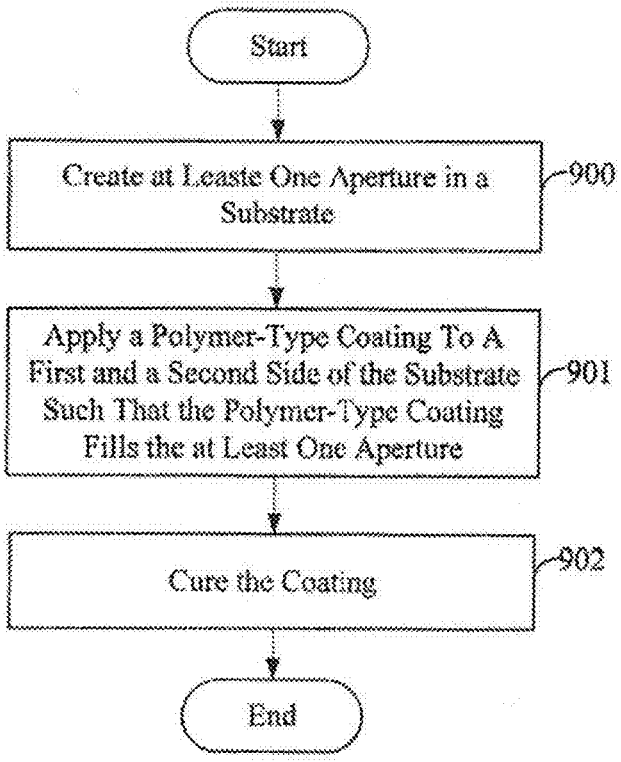
FIG. 9 is a flowchart of an exemplary method in accordance with an embodiment of the present disclosure.

FIG. 9 is a flowchart depicting an exemplary method in accordance with an embodiment of the present disclosure. In step 900, at least one aperture 101 (FIG. 1) is formed in a substrate 100 (FIG. 1). As described hereinabove, the substrate 100 may be a metal-like or plastic-like material. In addition, one aperture 101 or a plurality of apertures 101 may be formed randomly or in a pattern within the substrate 100 by drilling, punching, stamping or by another other method known in the art or future-developed.

In step 901, a polymer-type material is applied to a first and a second surface of the substrate 100 such that the polymer-type material forms coatings 102, 103 (FIG. 2) and fills the at least one aperture 101. In step 902, the coatings 102, 103 are cured. Such curing and application of the polymer-type material may be accomplished in any manner known in the art or future-developed.

As described hereinabove, the substrate 100 may be heated by convection and the substrate 100 coated with the polymer-type material. In addition, the substrate 100 may be placed in an oven, heated, the polymer-type material placed on the substrate 100, and the substrate 100 placed back in the oven. Further, electrical current may be used to heat the substrate 100 before the polymer-type material is applied or the polymer-type material may be cured in a pressurized vacuum, as described hereinabove.

The first surface of the substrate has a total original surface area. When apertures are added, this original surface area is reduced to a "net surface area." In the present invention, it is significant that the number and size of the apertures be such that the net surface area is at least 50% of the total original surface area. Even more preferably, the net surface area is at least 75% of the total original surface area.

Although the preceding description contains significant detail, it should not be construed as limiting the scope of the invention but rather as providing illustrations of the preferred embodiments of the invention. Thus, the scope of the present invention should be fixed by the claims rather than the specific examples given.

Having described my invention, I claim:

1. A method for coating a substrate, comprising:

a. providing a substrate, having a first surface and a second surface, wherein said first surface and said second surface are separated by a thickness of said substrate;

b. said first surface having an original surface area;

c. providing a plurality of apertures connecting said first surface to said second surface, wherein the presence of said plurality of apertures reduces said original surface area to a net surface area;

d. said net surface area being at least fifty percent of said original surface area;

e. providing a polymer having a melting temperature, wherein said polymer is capable of transitioning from a liquid state to a solid state;

f. heating said substrate above said melting temperature of said polymer;

g. spraying said polymer onto said second surface;

h. spraying said polymer onto said first surface;

i. wherein said heated substrate melts said polymer and some of said liquid polymer on said first surface flows into said apertures and adheres to said polymer on said second surface; and j. allowing said liquid polymer to solidify, so that said polymer on said first surface, said second surface, and in said apertures is linked together as a solid.

2. A method for coating a substrate as recited in claim 1, wherein said first surface is an outside surface and said second surface is an inside surface.

3. A method for coating a substrate as recited in claim 1, wherein said first surface is an inside surface and said second surface is an outside surface.

4. A method for coating a substrate as recited in claim 1, wherein said substrate is a utility pole.

5. A method for coating a substrate as recited in claim 1, wherein said substrate is heated to a temperature above 200 degrees Fahrenheit before applying said polymer.

6. A method for coating a substrate as recited in claim 5, wherein said substrate is heated to a temperature above 300 degrees Fahrenheit before applying said polymer.

7. A method for coating a substrate as recited in claim 1, wherein said net surface area is at least seventy-five percent of said original surface area.

8. A method for coating a substrate as recited in claim 1, wherein said polymer is applied as a single layer.

9. A method for coating a substrate as recited in claim 8, wherein said single layer is at least 0.250 inches thick.

10. A method for coating a substrate as recited in claim 9, wherein said single layer is no greater than 0.750 inches thick.

11. A method for coating a substrate, comprising:

a. providing a substrate, having a first surface and a second surface, wherein said first surface and said second surface are separated by a thickness of said substrate;

b. said first surface having an original surface area;

c. providing a plurality of apertures connecting said first surface to said second surface, wherein the presence of said plurality of apertures reduces said original surface area to a net surface area;

d. said net surface area being at least fifty percent of said original surface area;

e. providing a polymer having a melting temperature;

f. heating said substrate above said melting temperature of said polymer;

g. spraying said polymer onto said second surface in a solid state;

h. spraying said polymer onto said first surface in a solid state;

i. wherein said heated substrate melts said polymer on both of said surfaces so that said polymer flows into said apertures; and j. wherein said substrate is heated to a high enough temperature so that said melted polymer flows through said apertures before said polymer on said first surface, said second surface, and within said apertures solidifies to form a unified solid.

12. A method for coating a substrate as recited in claim 11, wherein said first surface is an outside surface and said second surface is an inside surface.

13. A method for coating a substrate as recited in claim 11, wherein said first surface is an inside surface and said second surface is an outside surface.

14. A method for coating a substrate as recited in claim 11, wherein said substrate is a utility pole.

15. A method for coating a substrate as recited in claim 11, wherein said substrate is heated to a temperature above 200 degrees Fahrenheit before applying said polymer.

16. A method for coating a substrate as recited in claim 15, wherein said substrate is heated to a temperature above 300 degrees Fahrenheit before applying said polymer.

17. A method for coating a substrate as recited in claim 11, wherein said net surface area is at least seventy-five percent of said original surface area.

18. A method for coating a substrate as recited in claim 11, wherein said polymer is applied as a single layer.

19. A method for coating a substrate as recited in claim 8, wherein said single layer is at least 0.250 inches thick.

20. A method for coating a substrate as recited in claim 9, wherein said single layer is no greater than 0.750 inches thick.

* * * * *